US005821214A

United States Patent [19]

Weibel

[11] Patent Number: 5,821,214

[45] Date of Patent: Oct. 13, 1998

[54] STABLE BLEACH-CONTAINING CLEANSING COMPOSITIONS WITH SOFT ABRASIVES

[75] Inventor: A. Thomas Weibel, Cranbury, N.J.

[73] Assignee: Reckitt & Colman Inc., Wayne, N.J.

[21] Appl. No.: 813,469

[22] Filed: Mar. 10, 1997

[30] Foreign Application Priority Data

Apr. 12, 1996 [GB] United Kingdom ..... 96075662

[51] Int. Cl.[6] ..... C11D 3/395; C11D 3/12

[52] U.S. Cl. ..... 510/368; 510/369; 510/380; 510/398; 510/434; 510/476

[58] Field of Search ..... 510/368, 369, 510/380, 398, 434, 476

[56] References Cited

U.S. PATENT DOCUMENTS

| | | | |
|---|---|---|---|
| 3,985,668 | 10/1976 | Hartman | 510/369 |
| 4,240,919 | 12/1980 | Chapman | 510/369 |
| 4,248,728 | 2/1981 | Puryear | 510/369 |
| 4,767,563 | 8/1988 | Buzzaccarini | 510/397 |
| 4,911,857 | 3/1990 | Machin et al. | 510/369 |
| 5,298,181 | 3/1994 | Choy et al. | 510/369 |
| 5,470,499 | 11/1995 | Choy et al. | 510/398 |
| 5,529,711 | 6/1996 | Brodbeck et al. | 510/398 |

FOREIGN PATENT DOCUMENTS

| | | | |
|---|---|---|---|
| 0 292 910 A2 | 11/1988 | European Pat. Off. | C11D 17/00 |
| 0 636 690 A2 | 2/1995 | European Pat. Off. | C11D 3/395 |
| 0 649 898 A2 | 4/1995 | European Pat. Off. | C11D 3/395 |
| WO 96/35771 | 11/1996 | WIPO | C11D 3/12 |

OTHER PUBLICATIONS

Database WPI, No. AN 85–113569 and JP 60 066 100 A
Copy of PCT International Search Report for PCT/US97/03728 dated 21 Aug. 1997.

*Primary Examiner*—Jacqueline V. Howard
*Attorney, Agent, or Firm*—Fish & Richardson P.C.

[57] ABSTRACT

A hard surface scouring cleaner composition comprises, by weight, (a) from 0.5 to 10% of soft abrasive particles, (b) from 0.5 to 2.5% of a chlorine-containing bleach, (c) from 0.2 to 3.0% of a thickening system comprising from 0.2 to 3.0%, based on the weight of the composition, of a cross-linked polyacrylate resin having a molecular weight in the range of 1,000,000 to 10,000,000 and from 0 to 2.5% of a synthetic smectite clay, (d) from 0.25 to 3.0% of a bleach-stable surfactant system comprising mainly anionic surfactants, (e) from 0 to 3.0% of an electrolyte selected from the group comprising sodium or potassium carbonates or silicates, and (f) sufficient amount of sodium or potassium hydroxide to provide a pH in the range of 11.5 to 13.5. These compositions have an apparent viscosity as measured on a Brookfield RVTDV-II with a #6 spindle at 50 rpm of from 0.5 to 7 Kcps and at 1 rpm of from 10 to 150 Kcps. The abrasive particles are preferably organic particles such as polyethylene or polypropylene.

19 Claims, No Drawings

STABLE BLEACH-CONTAINING CLEANSING COMPOSITIONS WITH SOFT ABRASIVES

FIELD OF THE INVENTION

This invention relates to hard surface scouring cleansers containing hypochlorite bleach which are thickened with a polyacrylate resin or a combination of a synthetic smectite clay and a polyacrylate resin and which contain "soft" organic abrasive particles. More particularly, it relates to such compositions containing particulate abrasives which maintain high active chlorine stability over a long period of time and have good rinsability.

BACKGROUND OF THE INVENTION

Polymeric thickeners are often added to liquid products containing hypochlorite bleach in order to enhance their rheological properties so as to make them more suitable for use on non-horizontal surfaces. Among the problems encountered with such compositions is the fact that liquids containing hypochlorite bleach are destructive to most synthetic and natural thickeners. In recent years, there have been developed a number of thickened bleach products incorporating, as thickeners, certain polyacrylates and certain natural or synthetic clays of the smectite type which are somewhat less subject to degradation by the hypochlorite bleach. However, many of these polymeric substances, particularly the lower molecular weight polyacrylates, do not substantially increase viscosity. Furthermore, even though these compositions may show initial stability, they tend to degrade, with a resultant loss of chlorine activity within a few months. Therefore, in commercial practice, unless these products are used within a relatively short period of time, they lose their effectiveness as cleaning agents.

The B. F. Goodrich Company produces and distributes a series of Carbopol polyacrylate resins and it is known that some of these resins are useful in the formulation of thickened sodium hypochlorite cleaning compositions. These Carpobol resins generally promote the degradation of the available chlorine in the solutions but, with certain Carbopol resins, the rate of chlorine loss is sufficiently slow that chlorine loss is commercially acceptable.

U.S. Pat. No. 4,911,857 (Machin et al.) teaches the use of polyacrylates or polymethacrylates in aqueous liquid cleaning compositions comprising suspended particulate abrasive materials. The compositions can additionally contain a chlorine-releasing bleaching agent and certain Carbopol resins having molecular weights in the range of 500 to 3,000. These low molecular weight resins serve only as wetting agents. The high viscosity is provided by a combination of surfactants.

Choy U.S. Pat. No. 5,470,499 discloses thickened aqueous abrasive cleaners having inorganic particulate minerals as abrasives and polyacrylate resin as a thickening agent, and discloses that such cleansers have good rinsability.

Natural clays of the smectite or attapulgite type have been used as thickeners in cleaning compositions. See, for example, U.S. Pat. No. 3,985,668 (Hartman), U.S. Pat. No. 4,396,525 (Rubin), U.S. Pat. No. 4,877,544 (Gabriel), U.S. Pat. No. 4,772,424 (Marzec), U.S. Pat. No. 4,235,732 (Beyer) and U.S. Pat. No. 5,348,682 (Finley). It does not appear, from the disclosed art, that use of these natural clays alone would provide suitable thickening and a high level of chlorine stability.

The use of inorganic mineral particles as abrasive agents in cleaning compositions is known and most of the patent literature directed to these abrasive-containing compositions is concerned with methods to keep the particles in substantially uniform suspension. Furthermore, in most of the prior art concerned with abrasive cleaning solutions, the abrasive particles are inorganic minerals. Although these compositions are generally quite satisfactory as cleaning agents, there are certain disadvantages. First, these cleaners often leave behind a gritty residue which requires a lot of rinsing. Even when the particles are very fine and do not appear to be gritty in nature, there will still be a surface haze which is particularly visible on dark-coloured surfaces. Secondly, many of these abrasive products should not be used on relatively soft surfaces such as polymethyl (methacrylate), because they will scratch the surface and/or reduce transparency and shine. There is therefore a need to develop a bleach-containing cleanser, with a high level of chlorine stability, which would exhibit the cleaning power advantages provided by mineral abrasive products, but which are easier to rinse and do not damage relatively soft surfaces.

The use of organic particles such as, particularly, polyethylene or polypropylene powder, in cleaning compositions is known, for example, from U.S. Pat. No. 3,985,668 (Hartman), U.S. Pat. No. 4,240,919 (Chapman), and U.S. Pat. No. 4,931,207 (Cramer et al.). But, in these patents, the organic particles are disclosed as being fillers, suspending agents, etc., rather than abrasives.

The use of certain organic particles as abrasive agents is disclosed in U.S. Pat. No. 4,767,563 (Buzzaccarini) but the subject compositions do not contain bleaching agents.

U.S. Pat. No. 5,298,181 (Choy et al.) discloses thickened abrasive cleaning compositions, which optionally contain bleach. The abrasives are generally inorganic materials but there is an indication that melamine granules, urea formaldehyde, corn cobs and rice hulls can be employed. However, the thickening agent is colloidal alumina.

SUMMARY OF THE INVENTION

According to a first aspect of the present invention, there is provided a hard surface scouring cleaner composition comprising (a) from about 0.5 to about 10.0% abrasive particles, (b) from about 0.5 to about 2.5% of a chlorine-containing bleach, (c) from about 0.5 to about 3.0% of a thickening system comprising from 0.2 to 3.0%, based on the weight of the composition, of a cross-linked polyacrylate resin having a molecular weight in the range of 1,000,000 to 10,000,000 and from 0 to 2.5%, based on the weight of the composition, of a synthetic smectite clay, (d) from about 0.25 to about 3.0% of a bleach-stable surfactant system comprising mainly anionic surfactants, (e) from 0 to about 3.0% of an electrolyte selected from the group comprising sodium or potassium carbonates or silicates and mixtures thereof, and (f) sufficient amount of sodium or potassium hydroxide to provide a pH in the range of 11.5 to 13.5.

These compositions have an apparent viscosity as measured on a Brookfield RVTDV-II with a #6 spindle at 50 rpm of from 0.5 to 7 Kcps and at 1 rpm of from 10 to 150 Kcps.

The compositions of this invention can be more viscous than ordinary bleach gels and therefore such compositions have better "cling" to non-horizontal surfaces. Although they are abrasive-containing compositions, they can be somewhat less viscous than prior art abrasive-containing bleach compositions because the organic abrasives are considerably less dense than the particulate abrasives which require high viscosity in order to ensure that they remain suspended. The lower viscosity in the compositions of this invention permit easier dispensing and improved rinsability. The fact that the organic abrasives are softer than the particulate mineral abrasives heretofore used in bleach containing gels allows for use of the products of this invention on "softer" plastic surfaces such as shower stalls and microwave ovens.

In another aspect, this invention provides a method for cleaning surfaces with a thickened aqueous-based cleanser which comprises contacting the surface with a cleansing composition comprising:

(a) from about 0.5 to about 10.0% abrasive particles,
(b) from about 0.5 to about 2.5% of a chlorine-containing bleach,
(c) from about 0.5 to about 3.0% of a thickening system comprising from 0.2 to 3.0%, based on the weight of the composition, of a cross-linked polyacrylate resin having a molecular weight in the range of 1,000,000 to 10,000,000 and from 0 to 2.5%, based on the weight of the composition, of a synthetic smectite clay,
(d) from about 0.25 to about 3.0% of a bleach-stable surfactant system comprising mainly anionic surfactants,
(e) from 0 to about 3.0% of an electrolyte selected from the group comprising sodium or potassium carbonates or silicates and mixtures thereof, and
(f) sufficient amount of sodium or potassium hydroxide to provide a pH in the range of 11.5 to 13.5.

The apparent viscosity of the compositions usable in these methods, as measured on a Brookfield RVTDV-II with a #6 spindle at 50 rpm is from 0.5 to 7 Kcps and at 1 rpm is from 10 to 150 Kcps.

DETAILED DISCLOSURE

The abrasive component of the formulation is helpful for physically scouring stains on hard surfaces. Preferably the particles should be prepared by grinding since these will have irregular jagged edges which are of value for dislodging soils. Particles obtained directly from high temperature processes tend to be rounded and will be less satisfactory. The abrasive agent should be present in amounts from about 0.5 to about 10.0% by weight of the composition. The density of the abrasive particles should be approximately the same as the density of the cleanser composition itself. For example, the ratio of the density of the abrasive particles to the density of the composition can range from 0.75:1 to 1.25:1, preferably from 0.9:1 to 1.1:1. The hardness of the abrasive particles should be less than the hardness of common household plastics materials such as polymethyl (methacrylate). Since the abrasive particles will be combined with a chlorine-containing bleach such as sodium hypochlorite, polymeric substances should not be appreciably reactive with sodium hypochlorite or similar oxidants. Most organic polymeric substances conforming to the foregoing criteria are useful in the compositions of this invention but especially useful are polyethylene and polypropylene, because of their availability and bleach stability. The average particle size of the abrasive should be greater than 100 $\mu$m, preferably from 180 $\mu$m to 2 mm. The apparent molecular weight and density of such particles can be selected to provide the optimum performance for a variety of formulations and surfaces.

The scouring composition of this invention contains a chlorine oxidizing bleach derived from a hypochlorite. Generally, the hypochlorite component may be provided by a variety of sources which include sodium, potassium, lithium and calcium hypochlorites, chlorinated trisodium phosphate dodecahydrate, potassium and sodium dichloroisocyanurate and trichlorocyanuric acid. The preferred sources are sodium or potassium hypochlorite, particularly sodium hypochlorite. The hypochlorite is present in the composition in an amount equal to about 0.5 to about 2.5% by weight of the composition. Preferably, the hypochlorite will comprise from 0.75 to 2.0% of the composition.

Interaction of the cross-linked polyacrylate resin with the hypochlorite component of the composition is particularly important for maintaining the desirable characteristics of thickening and stability.

The hypochlorite component which is present in the composition can be an ordinary sodium hypochlorite bleaching formulation of the type sold for commodity purposes. Preferably, however, the hypochlorite component contains low levels of salts such as chlorides, since such low levels of salts promote higher viscosity in the composition. Ordinary sodium hypochlorite bleaching products sold for laundry or other commodity purposes can contain, for every 100 parts of NaOCl, about 78.5 parts of NaCl at the time of manufacturing. Degradation of bleach in storage leads to even higher ratios of NaCl to NaOCl. For purposes of this invention, the amount of NaCl present is preferably not more than 20.0% of the amount of NaOCl. As used herein, the term "hypochlorite bleach" is intended to mean a sodium hypochlorite formulation of the type sold for commodity purposes but it should be understood that, in such formulations, the amount of chloride salt is preferably less than 20% of the amount of hypochlorite.

In order to provide low levels of sodium chloride in the compositions, the preferred bleach component is selected or formed in a manner avoiding or minimizing the presence of undesirable salts. For example, sodium hypochlorite bleaching products are commonly formed by bubbling chlorine gas through liquid sodium hydroxide to result in formation of the corresponding hypochlorite, a method which produces large amounts of NaCl. Therefore, hypochlorite bleaches produced by such reactions are less desirable for the present invention unless the reaction is followed by salt separation step, which reduces the NaCl level to below 20.0% of the amount of NaOCl.

In addition to the use of hypochlorites formed from the reaction of chlorine with sodium hydroxide, the present invention contemplates the use of hypochlorites formed in other ways, such as by reaction of hypochlorous acid with sodium hydroxide or other metal hydroxides in order to produce the corresponding hypochlorite with water as the only substantial by-product. Sodium hypochlorite bleach produced in this manner is available from, for example, Olin Corporation which produces sodium hypochlorite bleach as a 36.0% solution in water, and is sold under the trademark Hypure.

As previously noted, the hypochlorite component of the invention preferably does not include chloride salt in excess of 20.0% of the hypochlorite. Most preferably, the amount of chloride will be less than 5.0% by weight of the hypochlorite component.

The ionic strength of the composition has an effect on thickening. If the total ionic strength (sum of the total alkali ions plus the negative counterions) exceeds about 5 g-ions per kilogram, it becomes difficult and more costly to achieve the desired level of thickening. Moreover, ionic strength also has some effect on stability of the composition; however, the effect of ionic strength on stability is minimal relative to the effects of the cross-linked polyacrylate polymer, the synthetic clay and the polymer stabilizer. Nevertheless, the ionic strength of the compositions of the present invention should be maintained at less than about 5 g-ions/Kg, preferably less than about 3 g-ions/Kg.

The thickening system for the compositions of this invention must include a cross-linked polyacrylate polymer of the type sold by the B. F. Goodrich Company under the trademark Carbopol and by 3V Chemical Company under the trademark Polygel. These polymeric resins should have a molecular weight in the range of from about 1,000,000 to about 10,000,000, preferably from 1,500,000 to 5,000,000. (These molecular figures are based on data supplied in the manufacturers' product literature.) A particularly suitable polymeric resin is Carbopol 695, which has a published molecular weight of about 3,000,000.

These cross-linked polyacrylate polymers are generally characterized as acrylic acid polymers which are non-linear and water-dispersible while being cross-linked with an additional monomer or monomers in order to exhibit a molecular weight in the desired range. Preferably, the polymers are cross-linked with a polyalkenyl polyether, the cross-linking agents tending to interconnect linear strands of the polymer to form the cross-linked resin. It has been found that, for the purposes of achieving good long term stability, without the loss of chlorine effectiveness, the polymeric cross-linking agent must be carefully chosen within the foregoing parameters.

The thickening system comprises from about 0.5% to about 3.0% of the composition, preferably from 1.0% to 2.5% thereof. The amount of polyacrylate component in the thickening system ranges from 0.2 to 3.0% based on the weight of the entire composition.

Preferably, the thickening system also comprises, in addition to the cross-linked polyacrylate polymer, up to 90.0%, more preferably from about 20.0% to about 80.0%, of its weight of a synthetic smectite-type clay similar to hectorite in structure and composition. In terms of the scouring composition of this invention, this clay component should comprise up to about 2.5% by weight of said composition. A synthetic, rather than a natural, clay is preferably used in order to avoid degradation of the composition owing to small amounts of impurities which may be found in natural products. The preferred synthetic smectite clays for use in this invention are sold under the trademark Laponite by Southern Clay Products, Inc. Particularly useful are Laponite RD and Laponite RDS with Laponite RD being especially preferred because it contains no phosphates. In terms of the scouring compositions of this invention, the preferred amount of synthetic smectite clay is from 0.25 to 2.0 weight %, more preferably from 0.5% to 1.5%. The addition of the synthetic smectite clay provides improved stability, particularly over long time periods.

Surfactants are added to the composition for supplemental thickening and/or for non-thickening purposes such as cleaning, improved stability, etc. Stability in the presence of the hypochlorite component is the basic criterion for selecting the surfactants to be included in the composition. Generally, a wide variety of surfactants may be sufficiently stable in the presence of hypochlorite bleaches and these include betaines, sarcosinates, taurates, alkyl sulphates, alkyl sulphonates, alkyl aryl sulphonates, alkylphenol ether sulphates, alkyl diphenyl oxide sulphonates, alkyl phosphate esters, etc. Generally, the surfactant systems will consist of anionic surfactants, but they may also include up to about 20.0% of nonionic and/or amphoterics.

Bleach-stable anionic surfactants useful in the present invention and which are especially stable in the presence of hypochlorite include water soluble alkali metal alkyl sulphates, alkyl sulphonates and alkylbenzene sulphonates, particularly the sodium salts of those having from 8 to 18 carbon atoms in the alkyl group, and sodium alkyl sarcosinate salts in which the alkyl group is a saturated hydrocarbon chain having from 7 to 17 carbon atoms, and aryl sulphonates. A preferred alkyl sulphate is lauryl sulphate. A preferred alkyl sulphonate is the secondary alkyl product sold as Hostapur SAS by Hoechst. A preferred sarcosinate is sodium lauroyl sarcosinate, sold under the trademark Hamposyl L30. A preferred aryl sulphonate is the product sold by Dow Chemical Company under the Dowfax 2A-1 which is principally sodium dodecyl diphenyloxide disulphonate.

Examples of other organic anionic non-soap surfactants include: sodium $C_{10}$–$C_{18}$ alkylsulphates such as sodium dodecylsulphate and sodium tallow alcoholsulphate; sodium $C_{10}$–$C_{18}$ alkanesulphonates such as sodium hexadecyl-1,1-sulphonate, and sodium $C_{12}$–$C_{18}$ alkylbenzenesulphonates such as sodium dodecylbenzenesulphonate. The corresponding potassium salts may also be employed. The amount of surfactant in the compositions of this invention ranges from about 0.25% to about 3.0%, preferably from 0.5 to 2.0%.

It is also necessary to employ a stabilizer for the purpose of achieving optimum stability of the solution and for pH adjustment. A sufficient amount of sodium or potassium hydroxide should be added to provide a pH in the range of from 11.5 to 13.5, preferably from 12.5 to 13.1.

Optional ingredients in the composition include an electrolyte such as sodium or potassium carbonate or silicate, in amounts ranging up to about 3.0% of the composition. The principal purpose of these carbonates and silicates is to act as a buffer in order to maintain the proper pH. In addition, it has been found that, in the compositions of this invention, the presence of a small amount, for example from 0.05% to 2.0%, preferably from 0.1% to 0.5% based on the weight of the composition, of sodium or potassium silicate results in higher apparent viscosity. Therefore, the silicates are preferred over the carbonates.

The hypochlorite composition preferably includes a bleach stable fragrance component and more preferably a bleach stable fragrance component which is relatively more volatile than the oxidants included in the hypochlorite component of the composition which are responsible for bleach odors.

The scouring compositions of the present invention together with the preferred cross-linked polyacrylate polymers for achieving combined thickening and stability may also include other components, either for enhancing one or more of these effects or for other purposes. For example, additional adjuncts in the composition may include buffers, builders, colorants, fluorescent whitening agents, pigments, etc. However, it is again noted that such adjuncts must be selected to the extent that they not substantially interfere with the preferred characteristics of the present invention as described above.

The scouring composition of the instant invention can be prepared by admixing the above-described essential and optional components together in the appropriate concentrations by any conventional means normally used to form thickened compositions. Some shear agitation is, of course, necessary to ensure preparation of the compositions of this type. It is preferred that, if the composition comprises a synthetic clay of the type described, said synthetic clay be kept in an alkaline slurry until the polyacrylate resin is added.

This invention will be better understood by reference to the following examples which are here included for illustrative purposes and are not intended to be limitations.

EXAMPLES

The following formulations were prepared and tested for viscosity on a Brookfield RVTVD-II device with a #6 spindle. All percentages are by weight and presented as "active" levels.

| Ingredient | % | % | % | % | % |
|---|---|---|---|---|---|
| EXAMPLE NO. | 1 | 2 | 3 | 4 | 5 |
| Abrasive[1] | 2.0 | 2.0 | 2.0 | 2.0 | 2.0 |
| Carbopol 695[3] | 0.5 | 0.5 | 0.67 | 0.83 | |
| Carbopol 1610[4] | | | | | 0.25 |
| Laponite RD[5] | 1.5 | 1.5 | 1.0 | 0.5 | 1.5 |
| NaOCl[2] | 1.25 | 1.25 | 1.25 | 1.25 | 1.25 |
| Hostapur SAS[6] | 2.0 | 2.0 | 2.0 | 2.0 | 2.0 |
| Na silicate[8] | | 0.1 | 0.1 | 0.1 | 0.1 |
| K silicate[9] | 0.11 | | | | |
| NaOH | | 0.66 | 0.70 | 0.93 | 0.60 |
| KOH | 0.95 | | | | |
| Water | q.s. to 100 | q.s. to 100 | q.s. to 100 | q.s. to 100 | q.s. to 100 |
| pH | 12.9 | 12.8 | 12.8 | 12.9 | 12.9 |
| Viscosity | Kcps | Kcps | Kcps | Kcps | Kcps |
| 1 RPM (60 sec.) | | 55 | 55 | 50 | 26 |
| 50 RPM (60 sec.) | | 3.4 | 4.0 | 2.9 | 1.4 |
| EXAMPLE NO. | 6 | 7 | 8 | 9 | 10 |
| Abrasive | 2.0 | 2.0 | 2.0 | 2.0 | 2.0 |
| Carbopol 695 | | | | 0.35 | |
| Carbopol 1610 | | 0.41 | | | 0.25 |
| Carbopol 694 | 0.5 | | 0.41 | | |
| Laponite RD | 1.5 | 0.5 | 0.5 | 2.0 | 2.0 |
| NaOCl | 1.25 | 1.25 | 1.25 | 1.25 | 1.25 |
| Hostapur SAS | 2.0 | 2.0 | 2.0 | 2.0 | 2.0 |
| Na silicate | 0.1 | 0.1 | 0.1 | 0.1 | 0.1 |
| NaOH | 0.69 | 0.65 | 0.90 | 0.57 | 0.55 |
| Water | q.s. to 100 | q.s. to 100 | q.s. to 100 | q.s. to 100 | q.s. to 100 |
| pH | 12.8 | 12.9 | 12.9 | 12.9 | 12.9 |
| Viscosity | Kcps | Kcps | Kcps | Kcps | Kcps |
| 1 RPM (60 sec.) | 20 | 33 | 21 | 40 | 50 |
| 50 RPM (60 sec.) | 1.3 | 1.8 | 1.2 | 2.9 | 2.8 |
| EXAMPLE NO. | 11 | 12 | 13 | 14 | 15 |
| Abrasive | 2.0 | 2.0 | 2.0 | 2.0 | 2.0 |
| Carbopol 695 | | | 0.4 | 0.4 | 0.4 |
| Carbopol 694 | 0.5 | | | | |
| Carbopol 672[3] | | 0.35 | | | |
| Laponite RD | 2.0 | 2.0 | 1.2 | 1.2 | 1.2 |
| NaOCl | 1.25 | 1.25 | 1.25 | 1.25 | 1.25 |
| Hostapur SAS | 2.0 | 2.0 | 2.0 | 2.0 | 2.0 |
| Na silicate | 0.1 | 0.1 | | 0.04 | 0.4 |
| NaOH | 0.68 | 0.50 | 0.59 | 0.59 | 0.70 |
| Water | q.s. to 100 | q.s. to 100 | q.s. to 100 | q.s. to 100 | q.s. to 100 |
| pH | 12.9 | 12.8 | 13.0 | 13.0 | 13.1 |
| Viscosity | Kcps | Kcps | Kcps | Kcps | Kcps |
| 1 RPM (60 sec.) | 28 | 23 | 22 | 23 | 41 |
| 50 RPM (60 sec.) | 2.1 | 1.5 | 0.98 | 1.1 | 2.2 |
| EXAMPLE NO. | 16 | 17 | 18 | 19 | 20 |
| Abrasive | 10 | 10 | 5.2 | 2.0 | 5.0 |
| Carbopol 695 | 0.5 | 0.5 | 0.5 | 0.5 | 0.5 |
| Laponite RD | 1.5 | 1.5 | 1.5 | 1.5 | 1.5 |
| NaOCl | 1.25 | 1.25 | 1.24 | 1.25 | 1.25 |
| Polytergent 2A1[7] | 1.0 | 2.0 | 1.5 | 1.0 | 2.0 |
| Na silicate | 0.1 | 0.1 | 0.1 | 0.1 | 0.1 |
| NaOH | 0.7 | 0.7 | 0.7 | 0.7 | 0.7 |
| Water | q.s. to 100 | q.s. to 100 | q.s. to 100 | q.s. to 100 | q.s. to 100 |
| pH | 13.1 | 13.1 | 13.0 | 13.1 | 13.1 |
| Viscosity | Kcps | Kcps | Kcps | Kcps | Kcps |
| 1 RPM (60 sec.) | 130 | 66 | 87 | 21 | 69 |
| 50 RPM (60 sec.) | 4.92 | 3.8 | 3.4 | 1.46 | 3.4 |

[1]POLYIFF RD 3292, polypropylene particles with particle size between about 500 and about 850 $\mu$m, containing 5.0% fragrance.

-continued

| Ingredient | % | % | % | % | % |
|---|---|---|---|---|---|

[2]HYPURE from Olin Corporation, contains about 16.3% NaOCl in solution.
[3]Polyacrylic acid polymer from B.F. Goodrich Company, MW = about 3,000,000
[4]Polyacrylic acid copolymer from B.F. Goodrich Company.
[5]Synthetic smectite clay from Southern Clay Products
[6]Secondary alkane sulphonate, sodium salt, from Hoechst
[7]Dodecyldiphenyl ether disulphonic acid, sodium salt, from Olin Corporation
[8]"N" Silicate from PQ Corporation. Percentages shown are calculated amounts of solids.
[9]Kasil 33 from PQ Corporation. Percentage shown is the calculated amount of solids.

While the invention has been described in connection with certain specific embodiments thereof, it will be understood that it is capable of further embodiments and variations. This application is intended to cover any variations, uses or adaptations of the invention following, in general, the disclosed principles of the invention and including such departures from the disclosure as come within the known or customary practice in the art to which the invention pertains, including particularly such changes and variations as fall within the limits of the appended claims.

I claim:

1. A hard surface scouring cleaner composition having an apparent viscosity as measured on a Brookfield RVTDV-II with a #6 spindle at 50 rpm of from 0.5 to 7 Kcps and at 1 rpm of from 10 to 50 Kcps, said composition consisting essentially of, on a weight basis:

(a) from about 0.5 to about 10.0% of soft abrasive organic particles whose hardness is less than the hardness of polymethyl(methacrylate);

(b) from about 0.5 to about 2.5% of a chlorine containing bleach;

(c) from about 0.2 to about 3.0% of a thickening system comprising from 0.2 to 3.0%, based on the weight of the composition, of a cross-linked polyacrylate resin having a molecular weight in the range of 1,000,000 to 10,000,000 and from 0 to 2.5%, based on the weight of the composition, of a synthetic smectite clay;

(d) from about 0.25 to about 3.0% of a bleach-stable surfactant system consisting of one or more anionic surfactants;

(e) from 0 to about 3.0% of a buffer/electrolyte selected from the group consisting of sodium or potassium carbonates or silicates, and mixtures thereof; and (f) a sufficient amount of sodium or potassium hydroxide to provide a pH of from 11.5 to 13.5.

2. A composition according to claim 1 in which the chlorine-containing bleach is a hypochlorite bleach.

3. A composition according to claim 2 in which the hypochlorite bleach comprises sodium hypochlorite and an amount of sodium chloride not exceeding 20% of the sodium hypochlorite.

4. A composition according to claim 3 which comprises from 0.75 to 2.0% of sodium hypochlorite.

5. A composition according to claim 2 comprising from 1.0 to 10.0% of soft abrasive particles.

6. A composition according to claim 5 in which the ratio of the density of the soft abrasive particles to the density of the composition ranges from 0.75:1 to 1.25:1.

7. A composition according to claim 6 in which the density ranges from 0.9:1 to 1.1:1.

8. A composition according to claim 2 in which the abrasive particles comprise polyethylene or polypropylene.

9. A composition according to claim 8 in which the average size of the abrasive particles is from about 100 $\mu$m to 2 mm.

10. A composition according to claim 9 in which the average size of the abrasive particles is from 180 $\mu$m to 2 mm.

11. A composition according to claim 2 in which the cross-linked polyacrylate resin has a molecular weight of from 1,500,000 to 5,000,000.

12. A composition according to claim 2 which comprises from 0.25 to 2.0% of synthetic clay.

13. A composition according to claim 12 which comprises from 0.5 to 1.5% of synthetic clay.

14. A composition according to claim 2 in which the surfactant system is present in an amount of from 0.5 to 2.5% of the composition.

15. A composition according to claim 14 in which the anionic surfactants are selected from the group consisting of sodium $C_8$ to $C_{18}$ alkyl sulphates, sodium $C_8$ to $C_{18}$ alkyl sulphonates, sodium $C_8$ to $C_8$ alkylbenzenesulphonates, sodium alkyl sarcosinate salts in which the alkyl is a saturated hydrocarbon chain having from 7 to 17 carbon atoms, aryl sulphonates and mixtures thereof.

16. A composition according to claim 2 in which the buffer/electrolyte is sodium silicate, potassium silicate or a mixture thereof, and is present in an amount of from 0.5 to 2.0% of the composition.

17. A composition according to claim 2 in which the pH is from 12.5 to 13.1.

18. A method for cleaning a surface which comprises contacting said surface with a cleaner composition consisting essentially of, on a weight basis:

(a) from about 0.5 to about 10.0% of soft abrasive organic particles whose hardness is less than the hardness of polymethyl(methacrylate);

(b) from about 0.5 to about 2.5% of a chlorine containing bleach;

(c) from about 0.2 to about 3.0% of a thickening system comprising from 0.2 to 3.0%, based on the weight of the composition, of a cross-linked polyacrylate resin having a molecular weight in the range of 1,000,000 to 10,000,000 and from 0 to 2.5%, based on the weight of the composition, of a synthetic smectite clay;

(d) from about 0.25 to about 3.0% of a bleach-stable surfactant system consisting of one or more anionic surfactants;

(e) from 0 to about 3.0% of a buffer/electrolyte selected from the group consisting of sodium or potassium carbonates or silicates, and mixtures thereof; and (f) a sufficient amount of sodium or potassium hydroxide to provide a pH of from 11.5 to 13.5, said composition having an apparent viscosity, as measured on a Brookfield RVTDV-II with a #6 spindle at 50 rpm of from 0.5 to 7 Kcps and at 1 rpm of from 10 to 150 Kcps.

19. A method according to claim 18 in which, in the composition (a) the abrasive particles comprise polyethylene or polypropylene, (b) the chlorine containing bleach is a hypochlorite bleach which comprises sodium chlorite and an amount of sodium chloride not exceeding 20% of the sodium hypochlorite, and (c) the thickening system comprises from 0.25 to 2.0% of synthetic clay.

* * * * *

UNITED STATES PATENT AND TRADEMARK OFFICE

CERTIFICATE OF CORRECTION

PATENT NO. : 5,821,214

DATED : 13 October 1998

INVENTOR(S) : A. Thomas Weibel

It is certified that error appears in the above-identified patent and that said Letters Patent is hereby corrected as shown below:

At column 9, line 17, after "sodium $C_8$ to" delete "$C_8$" and substitute --$C_{18}$--.

Signed and Sealed this

Twelfth Day of January, 1999

*Attest:*

*Attesting Officer*

*Acting Commissioner of Patents and Trademarks*